United States Patent [19]

Owen

[11] Patent Number: 4,526,680

[45] Date of Patent: Jul. 2, 1985

[54] SILICONE GLYCOL COLLECTORS IN THE BENEFICIATION OF FINE COAL BY FROTH FLOTATION

[75] Inventor: Michael J. Owen, Midland, Mich.

[73] Assignee: Dow Corning Corporation, Midland, Mich.

[21] Appl. No.: 615,395

[22] Filed: May 30, 1984

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS 3,072,256 1/1963 Gotle et al. ..... 209/166

FOREIGN PATENT DOCUMENTS 582839 12/1977 U.S.S.R. ..... 209/166

650656 3/1979 U.S.S.R. ..... 209/166

657855 4/1979 U.S.S.R. ..... 209/166

*Primary Examiner*—Bernard Nozick

*Attorney, Agent, or Firm*—Richard A. Kaba

[57] ABSTRACT

A froth flotation process for the beneficiation of fine coal is disclosed which employs as a collector a water-dispersible polyorganosiloxane or a mixture of water-dispersible polyorganosiloxanes which contain organic radicals selected from the group consisting of polyethylene oxide and polypropylene oxide radicals. The process of this invention is especially useful for the beneficiation of difficult-to-float fine coals.

16 Claims, No Drawings

SILICONE GLYCOL COLLECTORS IN THE BENEFICIATION OF FINE COAL BY FROTH FLOTATION

BACKGROUND OF INVENTION

This invention relates to a froth flotation process for the beneficiation of fine coal. More specifically, this invention relates to a froth flotation process for the beneficiation of fine coal using certain glycol-containing polyorganosiloxanes as collectors. The polyorganosiloxane collectors of this invention allow for improved beneficiation of fine coals, especially the difficult-to-float coals including highly oxidized coals.

In general, a froth flotation process for the beneficiation of fine coal occurs as finely disseminated air bubbles are passed through an aqueous fine coal slurry. Air bubble adhering particles (coal) are separated from the nonadhering particles (tailings) by flotation of the coal particles to the surface of the aqueous slurry where they are removed as a concentrate. The tailings or waste remain suspended in the slurry or fall to the lower levels of the slurry. Suitable reagents are normally added to the aqueous fine coal slurry to improve the selectivity and/or recovery of the process. Collectors and frothing agents are two types of additives which are normally used. The basic purposes of a frothing agent is to facilitate the production of a stable froth. The froth should be capable of carrying the beneficiated fine coal until it can be removed as a concentrate. The basic purpose of a collector is to render the desired coal particles hydrophobic so that contact and adhesion between the desired coal particles and the rising air bubbles is promoted. At the same time, the collector should be selective in that the tailings or waste are not rendered hydrophobic and thus do not float. Collectors are generally surface active reagents which preferentially wet or adsorb on coal surfaces and thus enhance the hydrophobic character of the coal particle by giving the coal surface a water repellent coating. Water insoluble, neutral hydrocarbon liquids derived from petroleum, wood, or coal tars have been employed in the froth flotation of coal. Diesel fuel, fuel oil, and kerosene are the most widely used collectors. In specific instances, other flotation reagents may be used. Such additional flotation reagents include depressing agents, activating agents, pH regulators, dispersing agents, and protective colloids which are well known in the art.

Polyorganosiloxanes have been used in mineral flotation processes, Schoeld et al. in U.S. Pat. No. 2,934,208 (issued Apr. 26, 1960) concentrated a coarse sylvite fraction from a sylvite ore using froth flotation with a collector containing both an aliphatic amine and a water insoluble silicone fluid. The silicone fluid employed by Schoeld et al. included dimethyl silicones, phenyl silicones, and methyl hydrogen silicones. Gotte et al. in U.S. Pat. No. 3,072,256 (issued Jan. 8, 1963) discloses the separation of galena and sphalerite present in sulfidic ores by froth flotation using conventional frothing agents and polyorganosiloxanes as collectors where the polyorganosiloxane is in the form of an emulsion with a surface-active nitrogen-containing organic compound. The polyorganosiloxanes of Gotte et al. contained methyl radicals and at least one alkyl radical containing more than two carbon atoms. Smith et al. in U.S. Pat. No. 3,640,385 (issued Feb. 8, 1972) teaches the concentration of sylvite from sylvinite or other potassium chloride ores using a froth flotation system with small amounts of silicone polymers as auxiliary agents in conjunction with primary amines and aliphatic and/or aromatic oils as collectors. The organic radicals on the silicone polymers of Smith et al. included methyl, phenyl, ethyl, propyl, butyl, hydrogen, chlorine, and bromine radicals. Leonov et al., in USSR Inventor Certificate No. 652,974 (Mar. 25, 1979), employed di-[2-(glycidyloxy)ethoxyethyl]ether-1,3-di(oxymethyl)tetramethyldisiloxane as a frothing agent in the froth flotation of a lead-zinc ore.

Siloxanes have also been used to a limited extent in the froth flotation of coal. Petukhov et al., in USSR Inventor Certificate No. 582,839 (Dec. 5, 1977), employed a mixture of linear and cyclic polysiloxanes of the general formula $$Si_nO_{n-1}(OC_2H_5)_{(2n+2)}$$

where n is 2–4 and

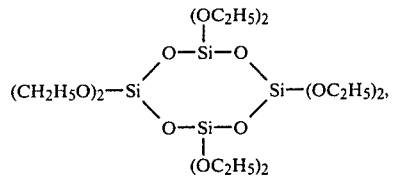

respectively, as frothing agents for the froth flotation of coal. The collector employed was kerosene. Petukhov et al., in USSR Inventor Certificate No. 650,656 (Mar. 5, 1979) employed polyhaloorganosiloxanes containing methyl, ethyl, $—C_6H_5X_2$, and $—CH_2CH_2CX_3$ radicals, where X is a halogen atom, as frothing agents in the flotation of coal. The collector employed was kerosene. Polydimethylsiloxanes have also been used in the froth flotation of coal with only limited success.

An object of this invention is to provide an improved froth flotation process for the beneficiation of fine coal. Another object is to provide new polyorganosiloxane collectors for use in the froth flotation of fine coal. Other objects will be apparent to one skilled in the art upon consideration of this specification.

THE INVENTION

This invention relates to a froth flotation process for the beneficiation of fine coal, which process comprises the steps of forming an aqueous slurry of the fine coal, adding a collector and a frothing agent to the aqueous fine coal slurry, subjecting the aqueous fine coal slurry containing the collector and frothing agent to a froth flotation manipulation, and separating the tailings of the froth flotation manipulation from the floated material which consists essentially of the beneficiated fine coal, wherein the collector is a water-dispersible polyorganosiloxane or mixture of water-dispersible polyorganosiloxanes of the general formula $$R_aQ_bSiO_{(4-a-b)/2}$$

wherein the sum (a+b) has an average value of 0.9 to 2.7, a has an average value of zero to less than four, b has an average value of greater than zero to less than four, R is a monovalent alkyl radical containing from 1 to 20, inclusive, carbon atoms or a —OH radical, and Q is an organic radical attached to silicon through a Si—C bond and selected from the group consisting of polyethylene oxide radicals and polypropylene oxide radicals.

This invention also relates to a froth flotation process for the beneficiation of fine coal, which process comprises forming as aqueous slurry of the fine coal containing a collector and a frothing agent, subjecting the aqueous slurry of the fine coal containing the collector and frothing agent to a froth flotation manipulation, and separating the tailing of the froth flotation manipulation from the floated material which consists essentially of the beneficiated fine coal wherein the collector is a water-dispersible polyorganosiloxane or a mixture of water-dispersible polyorganosiloxanes of general formula $$Q_cR_{(3-c)}SiO[R_2'SiO]_n[R'QSiO]_nSiR_{(3-d)}Q_d$$

where n has a value of 0 to 25, inclusive; m has a value of 0 to 12, inclusive; c and d are both independently equal to 0 or 1; the sum (m+c+d) is equal to or greater than 1; R is a monovalent alkyl radical containing from 1 to 20, inclusive, carbon atoms or a —OH radical; R' is a monovalent alkyl radical containing from 1 to 20, inclusive, carbon atoms; and Q is an organic radical attached to silicon through a Si—C bond and selected from the group consisting of polyethylene oxide radicals and polypropylene oxide radicals.

This invention relates to a froth flotation process for the beneficiation or purification of fine coal. Coals which may be treated by the process of this invention include mainly the bituminous coals although other coals may be treated. Although the process of this invention may be used for coals which are easy-to-float using conventional collectors, this process is especially useful for the difficult-to-float coals. An example of such a difficult-to-float coal would be a coal which is highly oxidized. Such highly oxidized coals can be floated with conventional collectors only with difficulty resulting in an uneconomical process with poor recovery and/or poor selectivity.

Generally the fine coal to be purified by the process of this invention has particles less than about 30 mesh (0.6 mm). Although larger particle size coal fractions may be purified by the froth flotation process of this invention, such a process will generally be uneconomical. It is generally preferred that the fine coal purified by the process of this invention have a particle size of less than about 50 mesh (0.3 mm). Naturally, coals with much smaller particle sizes may be purified by the froth flotation process of this invention. In fact, for coals less than 200 mesh (0.075 mm), a froth flotation process may be the only commercially available method for the coal beneficiation.

To treat a fine coal material by the process of this invention, the fine coal must be in the form of an aqueous slurry. The solids content or pulp density of the aqueous slurry will depend on the specific coal that is to be processed. Generally, the aqueous slurry will contain from about 2 to 25 percent coal solids. Normally, a higher pulp density is employed with coarser coal particles and a lower pulp density is beneficial with finer coal particles. For very small coal particles (less than 200 mesh), pulp densities of about 2 to 5 percent are normally preferred. As one skilled in the art realizes, these pulp density ranges are intended only as guidelines. The optimum pulp density for a given fine coal and processing conditions should be determined by routine experimentation.

In the operation of the process of this invention, a frothing agent and a collector are added to the aqueous slurry of the fine coal. The collector and frother, but especially the collector, may be added to the aqueous medium before the fine coal is slurried if desired. The frothing agent and collector may be added at the same time or at separate times. For a difficult-to-float coal it is generally preferred that the collector be added to the aqueous slurry well before the actual froth flotation manipulation. By adding the collector for the aqueous slurry well upstream of the froth flotation cell, sufficient time for conditioning the coal particles is allowed. For the less difficult-to-float coal the collector may be added just before the actual froth flotation cell or upstream of the actual froth flotation cell. It is generally preferred that the frother be added just prior to the actual froth flotation manipulation in order to obtain a good froth for the actual froth flotation manipulation.

The collector and frother are added at a concentration level sufficient to obtain the desired beneficiation result. In practice, the actual collector and frother concentration level will be determined by the actual collector and frother used, the coal employed, the particle size distribution of the coal particles, the pulp density, the desired beneficiation effect, as well as other factors. Although the quantity of added reagents used will vary widely with conditions, frothers are usually added at a rate of about 0.05 to 2.0 kg per ton of coal and collectors at a rate of about 0.05 to 1.0 kg per ton of coal. Again these rates are intended only as guidelines. Higher or lower amounts may be useful in specific circumstances.

Frothers are used in the froth flotation process of this invention to facilitate the production of a stable froth. The frothers or frothing agents useful in this invention are well known in the art. Conventional frothing agents include, for example, aliphatic alcohols which are only slightly soluble in water such as amyl alcohols, butyl alcohols, terpinols, cresols, and pine oils. A preferred frothing agent is methylisobutylcarbinol.

The collectors used in this present invention are water-dispersible polyorganosiloxanes or mixtures of water-dispersible polyorganosiloxanes which contain one or more different types of organic radicals where the organic radicals are attached to silicon through a Si—C bond and are selected from the group consisting of polyethylene oxide and polypropylene oxide radicals. In addition to the polyethylene oxide and polypropylene oxide radicals, the polyorganosiloxanes may, and preferably do, contain monovalent alkyl radicals which contain from 1 to 20, inclusive, carbon atoms when the monovalent alkyl radicals are attached to silicon through a Si—C bond. Preferably, the monovalent alkyl radicals are methyl radicals. Hydroxyl radicals attached directly to silicon may also be present in the polyorganosiloxanes of this invention.

The polyethylene oxide and polypropylene oxide radicals may be represented by the general formula $$-D(OC_2H_4)_x(OC_3H_6)_yB.$$

In this structure D can be any alkylene radical containing from 2 to 18 carbon atoms. Thus D can be, for example, an ethylene, propylene, isopropylene, butylene, isobutylene, hexylene, octylene, decylene, dodecylene, hexadecylene or an octadecylene radical. It is preferred that D be an alkylene radical containing from 2 to 6 carbon atoms. The number of polyethylene oxide units present is defined by x which may vary from 0 to 20, inclusive. It is preferred that x range from 5 to 15, inclusive. The number of polypropylene oxide units present is defined by y which may vary from 0 to 5, inclusive. The sum (x+y) must be greater than or equal to 1. When x equals zero, the above formula describes a polypropylene oxide radical; when y equals zero the above formula describes a polyethylene oxide radical. Radicals containing both polyethylene oxide and polypropylene oxide units are suitable for use in the invention. It is preferred, however, that the radical contains only ethylene oxide units (y equals 0). When both ethylene oxide and propylene oxide units are present, the ratio of x to y is preferably at least 2 to 1. The final portion of the glycol is B which is a capping group selected from the group consisting of the —OR'', $$-OCR'', -OCOR'', \text{ and } -OCD'COOH$$

radicals wherein R'' is a hydrogen atom or a hydrocarbon radical free of aliphatic unsaturation which contains from 1 to 10 carbon atoms and D' is an alkylene radical containing from 1 to 18 carbon atoms. By way of illustration, the polyethylene oxide and/or polypropylene oxide radicals can be hydroxy, ether, carboxyl, acyloxy, carbonate or ester capped. Specific examples of R', in addition to the hydrogen atom, include the methyl, ethyl, propyl, butyl, isopropyl, cyclohexyl, phenyl, tolyl, benzyl, and decyl radicals. Specific examples of D' include methylene, ethylene, propylene, isopropylene, butylene, isobutylene, hexylene, octylene, decylene, dodecylene, hexadecylene, octadecylene, 1-dodecylethylene, 2-dodecylethylene and other aliphatic substituted alkylene radicals.

Polyorganosiloxanes which are useful in the process of this invention have the general formula $$R_aQ_bSiO_{(4-a-b)/2}$$

where a and b are numbers, the sum of which has an average value of 0.9 to 2.7, a has an average value of zero to less than four, b has an average value of greater than zero to less than four, R is a monovalent alkyl radical containing from 1 to 20, inclusive, carbon atoms or a —OH radical, and Q is an organic radical attached to silicon through a Si—C bond and selected from the group consisting of polyethylene oxide and polypropylene oxide radicals as described above. The polyorganosiloxane may contain siloxane units of the general formula $R_3SiO_{\frac{1}{2}}$, $R_2SiO$, $RSiO_{3/2}$, $SiO_2$, $R_2QSiO_{\frac{1}{2}}$, $RQ_2SiO_{\frac{1}{2}}$, $Q_3SiO_{\frac{1}{2}}$, $RQSiO$, $Q_2SiO$, $QSiO_{3/2}$. It is generally preferred, however, that siloxane units which contain more than one Q radical are present in limited amounts or not at all. It is also preferred that the amounts of monoorganosiloxane units and, especially, $SiO_2$ units be limited to less than 10 mol percent and, most preferably, less than 1 mol percent.

Preferred polyorganosiloxanes may be represented by the general formula $$Q_cR_{(3-c)}SiO[R_2'SiO]_n[R'QSiO]_mSiR_{(3-d)}Q_d,$$

where n has a value of 0 to 25, inclusive, preferably 0 to 5, inclusive; where m has a value of 0 to 12, inclusive, preferably 1 to 5, inclusive; c and d are both independently equal to 0 or 1; and the sum (m+c+d) is greater than or equal to one. It is preferred that both c and d are zero in which case m has a value of 1 to 12, inclusive, and the polyorganosiloxane formula reduces to $$R_3SiO[R_2'SiO]_n[R'QSiO]_mSiR_3,$$

where R, R', and Q are as defined above.

The polyorganosiloxanes that are useful in the process of this invention may be prepared by any of the methods disclosed in the art. Most useful polyorganosiloxanes have been disclosed in the voluminous polyorganosiloxane art; many are commercially available.

The polyorganosiloxanes or mixtures of polyorganosiloxanes must be water-dispersible; that is to say, the polyorganosiloxanes or mixtures of polyorganosiloxane must be soluble in water or emulsifiable in water. The water-emulsifiable polyorganosiloxane may be self-emulsifiable or it may be emulsifiable with the aid of one or more surfactants or it may be prepared in emulsified form by emulsion polymerization of suitable monomers. In the process of this invention the polyorganosiloxane collector may be added to the fine coal aqueous slurry in an undiluted or a diluted form such as an aqueous solution or aqueous emulsion. The viscosity of the polyorganosiloxane or polyorganosiloxane emulsion should not be so high so as to prevent a rapid and uniform distribution of the polyorganosiloxane throughout the fine coal slurry. Generally, a viscosity of about 3 to 1000 cst at 25° C. for the polyorganosiloxane or polyorganosiloxane emulsion is preferred with a viscosity of about 3 to 150 cst at 25° C. being most preferred.

The polyorganosiloxane collector of this invention may be combined with other collectors for the beneficiation of fine coal. A collector which consists of a polyorganosiloxane and mineral oil is one such blend.

The use of the polyorganosiloxane as collectors in the process of this invention results in an improved process for the froth flotation of fine coal. Improvement can be obtained in ash reduction and/or in total yield of beneficiated coal. The collectors of this invention are especially useful in the froth flotation of difficult to float coals such as highly oxidized coals or coals with slime problems where conventional collectors have only limited usefulness.

The following examples are meant to further teach how best to practice this invention and not to limit the invention.

All percentages are by weight unless otherwise noted. It will be realized by one skilled in the art that not all collectors will be satisfactory for all coals. Routine experimentation may be necessary to determine the optimum collector and process parameters for a given coal.

The polyorganosiloxanes that were used in these examples are denoted by letter codes which have the following meanings:

A. A 60 percent emulsion of a polydimethylsiloxane (viscosity about 350 cst) in water with about 3.8 percent trimethylnonylpolyethylene glycol ether (tradename Tergitol TMN-6 from Union Carbide) and about 0.85 percent of the sodium salt of an alkylarylpolyether sulfate (tradename Triton W-30 from Rohm & Haas Co.). This polydimethylsiloxane is included for comparative purposes only.

B. A polyorganosiloxane having the average formula $(CH_3)_3SiO[(CH_3)_2SiO]_7[CH_3QSiO]_3Si(CH_3)_3$ where Q is $-(CH_2)_3(OCH_2CH_2)_{11-12}OH$.

C. A mixture of polyorganosiloxanes of general formula $(CH_3)_3SiO[CH_3Q'SiO]_n[CH_3Q''SiO]_mSi(CH_3)_3$ where Q' is $-(CH_2)_3(OCH_2CH_2)_{20}(OCH(CH_3)CH_2)_{12}B$, Q'' is $-(CH_2)_3(OCH_2CH_2)_{12}B$, B is both $$-OC(=O)CH((CH_2)_{11}CH_2)CH_2COOH \text{ and}$$

$$-OC(=O)CH_2CH((CH_2)_{11}CH_3))COOH$$

and n and m are both 1, 2, and 3.

D. A polyorganosiloxane of general formula $Q(CH_3)_2SiO[(CH_3)_2SiO]_{15}Si(CH_3)_2Q$ where Q is $-(CH_2)_3(OCH_2CH_2)_7OH$.

E. A polyorganosiloxane of general formula $(CH_3)_3SiO[(CH_3)_2SiO]_{67}[CH_3QSiO]_3Si(CH_3)_3$ where Q is $-(CH_2)_2(OCH_2CH(CH_3))_{2.5}OH$.

F. A polyorganosiloxane of general formula $(CH_3)_2QSiO[(CH_3)_2SiO]_nSiQ(CH_3)_2$ where Q is $-(CH_2)_3(OCH_2CH_2)_{12}OH$ and n has an average value of 12 to 14.

G. A polyorganosiloxane of general formula $(CH_3)_3SiO[(CH_3)_2SiO]_{23}[CH_3QSiO]_2Si(CH_3)_3$ where Q is $-(CH_2)_3(OCH_2CH_2)_{12.5}OOCCH_3$.

Flotation Tests. Most froth flotation tests were carried out in a Reay/Ratcliff flotation cell which is more fully described in Reay and Ratcliff, *Can. J. Chem. Engng.*, 53, 481(1975). The Reay/Ratcliff cell uses a standard Buchner funnel with a fused-in-place sintered disc of porosity 3. Four vertical baffles were added to the funnel to minimize vortex formation during stirring. Agitation was by mechanical stirrer using a pitched four-blade impeller. A small diaphragm pump was used to pressurize the air for bubble formation. For each series of tests about 8 l of an aqueous coal slurry (about 10–12% solids) was prepared. The slurry was continuously stirred. For each test, a 100 ml sample of the aqueous slurry was removed and treated with a predetermined amount of the test collector. The treated aqueous slurry was conditioned by stirring at about 800 rpm for one minute. The treated, conditioned sample was then transferred to the flotation cell where the frothing agent was added. The resulting slurry was further conditioned for 10 seconds with stirring. Flotation was then carried out for three minutes at an aeration rate of 2 liters per minute. Frother and distilled water were added, when needed, to maintain a suitable froth and water level in the cell. The floated coal sample was collected, dried to a constant weight at 105° C., and then analyzed for ash content according to Australian Standards 1038 Part 3-1979. The recovery or percentage yield was determined by Australian Standard 2579.1-1983 by the equation $$\text{Recovery (\%)} = (Mc/Mr) \times 100$$

where Mc equals the weight of the concentrate and Mr equals the weight of the reconstituted feed.

A few flotation experiments were carried out in a larger scale Denver laboratory flotation machine available from Joy Process Equipment Ltd., Surrey, England. A glass one liter flotation cell was used. The aqueous coal slurry was prepared by adding 50 g of coal (−50/+200 mesh) to one liter of water. The aqueous slurry was mixed for 1–2 minutes in the flotation cell at which point the collector was added and the mixing continued for five minutes. The frothing agent was then added and the aqueous slurry mixed for 30 seconds. Impeller speed was about 1300 rpm. The air flow rate was approximately 0.25 cubic feet per minute. The froth product was collected for three minutes. Ash analysis was carried out as before.

All flotation experiments were carried out at room temperature, approximately 21° C.

EXAMPLES 1–5

The fine coal used was from the Upper Permian German Creek Formation from the German Creek Coal Preparation Plant located about 208 km west of Rockhampton, Queensland, Australia, and owned by German Creek Coal Pty, Ltd. This German Creek coal is classified as a medium volatile bituminous coal in the ASTM classification system. An aqueous slurry of the German Creek coal was subjected to a froth flotation manipulation using different collectors in the Reay/Ratcliff cell. The frother employed was methylisobutylcarbinol which was present at a level of 0.1 kg per ton of coal. The original German Creek coal had an ash content of 27.9 weight percent. The results are presented in Table I. Examples 1 and 2 are for comparative purposes.

TABLE I

| | Collector | | Beneficiated Coal Product | | |
|---|---|---|---|---|---|
| Example | Identity | Level (kg/ton) | Product Ash, % | Ash Reduction, % | Yield % |
| 1 | Diesel Fuel | 0.6 | 19.4 | 30.5 | 62.6 |
| 2 | A | 0.1 | 20.5 | 26.5 | 36.8 |
| 3 | B | 0.1 | 21.4 | 23.3 | 43.3 |
| 4 | C | 0.1 | 23.1 | 17.2 | 67.2 |
| 5 | D | 0.1 | 19.8 | 29.0 | 60.5 |

Polyorganosiloxanes, which contain polyethylene oxide radicals and/or polypropylene oxide radicals, gave a significantly improved yield, and in some cases an improved ash reduction, as compared to the prior art siloxane collector as shown in Example 2.

EXAMPLES 6–8

The fine coal employed in these Examples was from the Upper Permian Wittingham coal seam from the Liddell State Coal Preparation Plant near Ravensworth, New South Wales, Australia, which is owned by Elcom Collieries Pty. Ltd. This Wittingham coal is a high volatile A bituminous coal in the ASTM classification system. An aqueous slurry of this coal was subjected to a froth flotation manipulation using various collectors in the Reay/Ratcliff cell. The frothing agent was methylisobutylcarbinol at a level of 0.1 kg per ton of coal. The Wittingham coal has an ash content of 22.2 percent before beneficiation. The results are presented in Table II. Examples 6 and 7 are for comparative purposes.

TABLE II

| | Collector | | Beneficiated Coal Product | | |
|---|---|---|---|---|---|
| Example | Identity | Level (kg/ton) | Product Ash, % | Ash Reduction, % | Yield % |
| 6 | Diesel Fuel | 0.6 | 15.3 | 31.1 | 80.2 |
| 7 | A | 0.1 | 14.5 | 34.7 | 52.1 |
| 8 | B | 0.1 | 18.9 | 14.9 | 80.0 |

The polyorganosiloxane which contained polyethylene oxide radicals did have a significantly improved yield as compared to the prior art siloxane collector as shown in Example 7.

EXAMPLES 9–11

The coal used in these examples is from the Goomyella Upper Seam which is located about 100 km southwest of Mackay, Queensland, Australia, and owned by Thiess Dampir Mitsui Coal Pty. Ltd. The Goomyella coal is a medium volatile bituminous coal. An aqueous slurry of the Goomyella coal was subjected to a froth flotation process using various collectors in the Reay/Ratcliff cell and a methylisobutylcarbinol frothing agent at a level of 0.1 kg per ton of coal. The Goomyella coal had an ash content of 19.1 percent. The results are presented in Table III. Examples 22 and 23 are for comparative purposes.

TABLE III

| | Collector | | Beneficiated Coal Product | | |
|---|---|---|---|---|---|
| Example | Identity | Level (kg/ton) | Product Ash, % | Ash Reduction, % | Yield % |
| 9 | Diesel Fuel | 0.6 | 12.2 | 36.1 | 73.7 |
| 10 | A | 0.1 | 17.0 | 11.0 | 40.2 |
| 11 | B | 0.1 | 17.3 | 9.4 | 42.9 |

EXAMPLES 12–16

Coal from the Liddell seam from the Liddell State Coal Preparation Plant near Ravensworth, New South Wales, Australia, was employed for Examples 28–33. The ASTM classification is high volatile A bituminous. An aqueous slurry of the Liddell coal was subjected to a series of froth flotation manipulations using various collectors in the Reay/Ratcliff cell. The frothing agent was methylisobutylcarbinol (MIBC). The results are presented in Table IV. Example 28 is for comparison purposes. All of the polyorganosiloxane collectors allowed for a greater ash reduction relative to the standard diesel fuel collector.

TABLE IV

| | Collector | | | | Beneficiated Coal Product | | |
|---|---|---|---|---|---|---|---|
| Example | Identity | Level (kg/ton) | MIBC (kg/ton) | Feed Ash, % | Product Ash, % | Ash Reduction, % | Yield % |
| 12 | Diesel Fuel | 0.51 | 0.09 | 19.5 | 15.7 | 19.5 | 76.4 |
| 13 | E | 0.10 | 0.09 | 19.5 | 13.7 | 29.7 | 76.9 |
| 14 | E | 0.10 | 0.08 | 20.2 | 13.0 | 35.6 | 74.6 |
| 15 | F | 0.11 | 0.08 | 21.7 | 13.8 | 36.4 | 69.6 |
| 16 | G | 0.10 | 0.08 | 18.1 | 13.1 | 27.6 | 66.6 |

EXAMPLES 17–37

The fine coal employed in these examples was Illinois No. 6 from the Captain Mine near Percy, Ill. Experiments were carried out in the Denver froth flotation equipment. The Illinois No. 6 coal had 14.4 percent ash before treatment. The results are presented in Table V. Examples 17–22 are presented for comparison purposes only. The frother, when employed, was methylisobutylcarbinol. The polyorganosiloxane collector was siloxane B.

TABLE V

| Example | Collector | | | Beneficiated Coal Product | | |
|---|---|---|---|---|---|---|
| | Identity | Level μl | MIBC μl | Product Ash, % | Ash Reduction, % | Yield % |
| 17 | None | — | 10 | 6.9 | 52.1 | 4.7 |
| 18 | None | — | 20 | 8.2 | 43.0 | 8.1 |

TABLE V-continued

| Example | Collector | | | Beneficiated Coal Product | | |
|---|---|---|---|---|---|---|
| | Identity | Level μl | MIBC μl | Product Ash, % | Ash Reduction, % | Yield % |
| 19 | Fuel Oil | 20 | 10 | 7.3 | 49.3 | 7.3 |
| 20 | Fuel Oil | 40 | 10 | 7.9 | 45.1 | 12.1 |
| 21 | Fuel Oil | 80 | 10 | 6.8 | 52.8 | 36.9 |
| 22 | Fuel Oil | 160 | 10 | 7.0 | 51.4 | 53.4 |
| 23 | B | 10 | 0 | 7.8 | 45.8 | 13.9 |
| 24 | B | 20 | 0 | 10.0 | 30.5 | 13.4 |
| 25 | B | 30 | 0 | 10.0 | 30.6 | 28.9 |
| 26 | B | 40 | 0 | 10.2 | 29.2 | 43.4 |
| 27 | B | 60 | 0 | 8.1 | 43.8 | 66.3 |
| 28 | B | 20 | 10 | 7.9 | 45.1 | 23.7 |
| 29 | B | 30 | 10 | 7.6 | 47.2 | 46.1 |
| 30 | B | 40 | 10 | 8.4 | 41.7 | 78.1 |
| 31 | B | 60 | 10 | 8.7 | 39.6 | 79.5 |
| 32 | B | 80 | 10 | 9.4 | 34.7 | 89.4 |
| 33 | B | 10 | 20 | 8.8 | 38.9 | 17.3 |
| 34 | B | 20 | 20 | 7.7 | 46.5 | 54.7 |
| 35 | B | 30 | 20 | 8.3 | 42.4 | 63.1 |
| 36 | B | 40 | 20 | 8.3 | 42.4 | 71.5 |
| 37 | B | 60 | 20 | 9.1 | 36.8 | 81.6 |

From this data it appears that the silicone glycols of this invention may act as both collector and frothing agent (Examples 23–27).

EXAMPLES 38–43

The fine coal employed in Examples 38–43 was Bradford coal from the Bradford Coal Company located at Bigler, Pa. Experiments were carried out in the Denver laboratory froth flotation machine using methylisobutylcarbinol as the frother. The Bradford coal had an ash content of 11.5 percent. The results are presented in Table VI. Examples 38–40 are presented for comparison only.

TABLE VI

| Example | Collector | | | Beneficiated Coal Product | | |
|---|---|---|---|---|---|---|
| | Identity | Level μl | MIBC μl | Product Ash, % | Ash Reduction, % | Yield % |
| 38 | None | — | 10 | 8.6 | 25.2 | 39.0 |
| 39 | Fuel Oil | 20 | 10 | 9.9 | 13.9 | 85.6 |
| 40 | Fuel Oil | 40 | 10 | 10.8 | 6.1 | 90.5 |
| 41 | B | 20 | 10 | 10.2 | 11.3 | 85.8 |
| 42 | B | 40 | 0 | 7.4 | 35.6 | 36.3 |
| 43 | B | 40 | 10 | 11.0 | 4.4 | 93.2 |

Example 42 shows that the polyorganosiloxanes of this invention may act as both collector and frothing agent for the beneficiation of fine coal by froth flotation.

That which is claimed is:

1. A froth flotation process for the beneficiation of fine coal, which process comprises the steps of forming an aqueous slurry of the fine coal, adding a collector and a frothing agent to the aqueous slurry of fine coal, subjecting the aqueous slurry of fine coal containing the collector and frothing agent to froth flotation, and separating the floated material which consists essentially of the beneficiated fine coal, wherein the collector is a water-dispersible polyorganosiloxane or a mixture of water-dispersible polyorganosiloxanes of general formula $$R_aQ_bSiO_{(4-a-b)/2}$$

wherein the sum (a+b) has an average value of 0.9 to 2.7, a has an average value of zero to less than four, b has an average value of greater than zero to less than four, R is a monovalent alkyl radical containing from 1 to 20, inclusive, carbon atoms or a —OH radical, and Q is an organic radical attached to silicon through a Si—C bond and selected from the group consisting of polyethylene oxide radicals and polypropylene oxide radicals.

2. A froth flotation process as defined in claim 1 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

3. A forth flotation process as defined in claim 2 wherein said frother is methylisobutylcarbinol.

4. A froth flotation process for the beneficiation of fine coal, which process comprises the steps of forming an aqueous slurry of the fine coal, adding a collector and a frothing agent to the aqueous slurry of fine coal, subjecting the aqueous slurry of fine coal containing the collector and frothing agent to froth flotation, and separating the floated material which consists essentially of the beneficiated fine coal, wherein the collector is a water-dispersible polyorganosiloxane or a mixture of water-dispersible polyorganosiloxanes of general formula $$Q_cR_{(3-c)}SiO[R_2'SiO]_n[R'QSiO]_mSiR_{(3-d)}Q_d$$

where n has a value of 0 to 25, inclusive; m has a value of 0 to 12, inclusive; c and d are both independently equal to 0 or 1; the sum (m+c+d) is equal to or greater than 1; R is a monovalent alkyl radical containing from 1 to 20, inclusive, carbon atoms or a —OH radical; R′ is a monovalent alkyl radical containing from 1 to 20, inclusive, carbon atoms; and Q is an organic radical attached to silicon through a Si—C bond and selected from the group consisting of polyethylene oxide radicals and polypropylene oxide radicals.

5. A froth flotation process as defined in claim 4 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

6. A froth flotation process as defined in claim 4 wherein both c and d are zero and m has a value of 1 to 12, inclusive.

7. A froth flotation process as defined in claim 6 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

8. A froth flotation process as defined in claim 6 wherein x has the value of 5 to 15, inclusive; wherein, when y is greater than zero, the ratio of x to y is at least 2 to 1.

9. A froth flotation process as defined in claim 8 wherein y equals zero and B is —OH.

10. A froth flotation process as defined in claim 4 wherein said polyethylene oxide radicals and said polypropylene oxide radicals are described by the general formula $$-D(OC_2H_4)_x(OC_3H_6)_yB$$

where D is an alkylene radical containing from 2 to 18 carbon atoms; x has a value of 0 to 20, inclusive; y has a value of 0 to 5, inclusive; the sum (x+y) is equal to or greater than 1; and B is selected from the group consisting of —OR″, $$-O\overset{O}{\overset{\|}{C}}R'', \quad -O\overset{O}{\overset{\|}{C}}OR'', \text{ and } -O\overset{O}{\overset{\|}{C}}D'COOH$$

where R″ is a hydrogen atom or a hydrocarbon radical free of aliphatic unsaturation which contains from 1 to 10 carbon atoms and where D′ is an alkylene radical containing from 1 to 18 carbon atoms.

11. A froth flotation process as defined in claim 10 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

12. A froth flotation process as defined in claim 10 wherein both c and d are zero and m has a value of 1 to 12, inclusive.

13. A froth flotation process as defined in claim 12 wherein x has the value of 5 to 15, inclusive; wherein, when y is greater than zero, the ratio of x to y is at least 2 to 1.

14. A froth flotation process as defined in claim 13 wherein y equals zero and B is —OH.

15. A froth flotation process as defined in claim 12 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

16. A froth flotation process as defined in claim 15 wherein said frother is methylisobutylcarbinol.

* * * * *